US005961285A

United States Patent [19]

Meneice et al.

[11] Patent Number: 5,961,285

[45] Date of Patent: Oct. 5, 1999

[54] METHOD AND APPARATUS FOR REMOVING BOTTOM DROSS FROM MOLTEN ZINC DURING GALVANNEALING OR GALVANIZING

[75] Inventors: David J. Meneice, Ashland, Ky.; Steven L. Boston, Newburgh, Ind.

[73] Assignee: AK Steel Corporation, Middletown, Ohio

[21] Appl. No.: 08/792,922

[22] Filed: Jun. 19, 1996

[51] Int. Cl.[6] ..... F04D 1/12; F04D 29/70; F04D 7/06; F04B 17/03

[52] U.S. Cl. ..... 415/200; 415/200; 415/216.1; 415/213.4; 415/126; 415/127; 415/217.1; 417/361

[58] Field of Search ..... 415/200, 217.1, 415/213, 216.1, 127, 126; 417/361

[56] References Cited

U.S. PATENT DOCUMENTS

| | | |
|---|---|---|
| 220,768 | 10/1879 | Morewood . |
| 2,159,297 | 5/1939 | Shover . |

(List continued on next page.)

FOREIGN PATENT DOCUMENTS

| | | |
|---|---|---|
| 1020622 | 2/1953 | France . |
| 50-079409 | 6/1975 | Japan . |
| 52-102860 | 8/1977 | Japan . |
| 60-096362 | 5/1985 | Japan . |
| 61-288029 | 12/1986 | Japan . |
| 62-185863 | 8/1987 | Japan . |
| 62-185864 | 8/1987 | Japan . |
| 63-090798 | 4/1988 | Japan . |
| 10510000 | 2/1989 | Japan . |
| 2034760 | 2/1990 | Japan . |
| 3140448 | 6/1991 | Japan . |
| 3207843 | 9/1991 | Japan . |
| 4052257 | 2/1992 | Japan . |
| 4154948 | 5/1992 | Japan . |
| 4358051 | 12/1992 | Japan . |
| 5125511 | 5/1993 | Japan . |
| 5295504 | 11/1993 | Japan . |
| 5295505 | 11/1993 | Japan . |
| 5295506 | 11/1993 | Japan . |
| 6041705 | 2/1994 | Japan . |
| 6071472 | 3/1994 | Japan . |
| 6299308 | 10/1994 | Japan . |
| 6306556 | 11/1994 | Japan . |
| 7501657 | 2/1995 | Japan . |
| 7084094 | 3/1995 | Japan . |
| 7150317 | 6/1995 | Japan . |
| 7166309 | 6/1995 | Japan . |
| 7207418 | 8/1995 | Japan . |
| 7207419 | 8/1995 | Japan . |
| 7331401 | 12/1995 | Japan . |
| 8003705 | 1/1996 | Japan . |
| 8003709 | 1/1996 | Japan . |
| 8060320 | 3/1996 | Japan . |
| 8074016 | 3/1996 | Japan . |
| 8085857 | 4/1996 | Japan . |
| 8269659 | 10/1996 | Japan . |
| 8325686 | 12/1996 | Japan . |
| 9013154 | 1/1997 | Japan . |
| 9280748 | 10/1997 | Japan . |
| WO 8505411 | 12/1985 | WIPO . |

*Primary Examiner*—F. Daniel Lopez
*Assistant Examiner*—Rhonda Barton
*Attorney, Agent, or Firm*—Frost & Jacobs LLP

[57] ABSTRACT

An apparatus for removing bottom dross from molten zinc contained in a coating pot includes a pump, a traversing carriage for positioning the inlet of the pump in a desired horizontal location and a slide mechanism for positioning the inlet of the pump in a desired vertical location. The pump is moved in horizontal and vertical direction to remove the accumulated bottom dross. The bottom dross contained in molten zinc is pumped into a V-shaped channel and allowed to flow into either a removable basket or into a pre-melt pot. The pump of the present invention is a pedestal, centrifugal graphite pump powered by an air motor. The pump has a housing enclosing an impeller. The distance between the impeller and the inner wall of the housing is sufficiently large to avoid plugging by the bottom dross but sufficiently small to permit pumping.

25 Claims, 5 Drawing Sheets

U.S. PATENT DOCUMENTS

| | | | |
|---|---|---|---|
| 2,166,249 | 7/1939 | Herman . | |
| 2,377,632 | 6/1945 | Keller . | |
| 3,724,831 | 4/1973 | Huffman | 266/38 |
| 3,828,723 | 8/1974 | Herman . | |
| 3,836,280 | 9/1974 | Koch . | |
| 3,871,632 | 3/1975 | Wunsche . | |
| 4,254,158 | 3/1981 | Fukuzuka et al. . | |
| 4,275,098 | 6/1981 | Gunji et al. . | |
| 4,437,605 | 3/1984 | Tucker et al. . | |
| 4,476,805 | 10/1984 | Higuchi et al. . | |
| 4,672,912 | 6/1987 | Derrico . | |
| 4,940,384 | 7/1990 | Amra et al. | 415/121.2 |
| 5,020,779 | 6/1991 | Lindblom et al. | 415/121.2 |
| 5,135,781 | 8/1992 | Schluckebier et al. | 415/121.2 |
| 5,165,858 | 11/1992 | Gilbert et al. . | |
| 5,203,681 | 4/1993 | Cooper | 415/121.2 |
| 5,310,412 | 5/1994 | Gilbert et al. | 415/121.2 |
| 5,470,201 | 11/1995 | Gilbert et al. | 415/200 |
| 5,558,715 | 9/1996 | Abed et al. | 415/200 |
| 5,586,863 | 12/1996 | Gilbert et al. | 415/200 |
| 5,587,017 | 12/1996 | Yamanaka et al. | 415/200 |
| 5,597,289 | 1/1997 | Thut . | |
| 5,622,481 | 4/1997 | Thut | 415/200 |

METHOD AND APPARATUS FOR REMOVING BOTTOM DROSS FROM MOLTEN ZINC DURING GALVANNEALING OR GALVANIZING

BACKGROUND OF THE INVENTION

The present invention relates to hot dip coating of steel strip with molten metal, such as, zinc. More particularly, the present invention relates to removing and recovering bottom dross from the molten metal, such as, zinc during galvannealing or galvanizing.

In some galvannealing and galvanizing processes, a dross is formed in the liquid metal bath. The dross that has the specific gravity higher than that of the molten metal (i.e., bottom dross) gradually sinks and deposits at the bottom of the bath. Once a significant amount of bottom dross is accumulated, turbulence caused, for example, by the steel strip passing through the bath can dislodge particles of the accumulated dross bottom and bring it in contact with the steel strip. The dross deposited on the surface of the steel strip can cause serious quality problems in the form of dents, irregularities and non-uniform appearance of the product.

For example, bottom dross forms during processes of galvannealing of steel strip with zinc in the presence of less than about 0.15 percent by weight of aluminum. Aluminum is added to molten zinc in order to facilitate adhesion of the zinc to steel. When the concentration of aluminum in the molten zinc is above about 0.15 percent, the thermodynamic equilibrium of the system does not produce bottom dross. However, for efficient galvannealing the level of aluminum should be less than about 0.15 percent by weight, generally less than 0.13 percent by weight. At those lower concentrations, the thermodynamic equilibrium produces an intermetallic Zn—Fe phase. The predominant intermetallic phase is the delta phase ($FeZn_7$). However, zeta phase $FeZn_{13}$ is also often present. Delta and Zeta phases are small crystalline aggregates that have specific density slightly higher than that of the molten zinc. Accordingly, the dross slowly descends to the bottom of the pot and accumulates these during the production campaign. Once significant amounts of bottom dross accumulate in the pot, the turbulence periodically dislodges particles of the dross and brings them in contact with the surface of the steel strip passing through the pot. When the dislodged dross deposits on the surface, it detrimentally effect the quality and the appearance of the galvannealed steel. The areas containing dross create irregularities and protrusions that are unsuitable for use in the production of exterior automotive body panels and the like. Additional quality and maintenance problems are caused by the dislodged dross attaching to and accumulating on the rollers that transport the steel strip through the pot.

To avoid these problems, various methods have been devised to periodically remove bottom dross from the pot. These methods include manual removal of the accumulated dross by specially designed tools, such as a clamshell, a back hoe and a scooper. These manual methods of removing bottom dross are not satisfactory for several reasons. First, the galvannealing operation must be shut down during the removal. The shut down causes significant operating losses. Second, the clean up is time consuming and labor intensive because colloidal crystalline bottom dross is difficult to capture. Third, the attempts to capture dross causes turbulence which resuspends some of it. Finally, only a limited amount of the dross can actually be captured and removed during each clean-up operation. Accordingly, the uncaptured dross gradually accumulates causing an increasing frequency of interruptions of production for dross removal.

To overcome the problems inherent in the manual methods of removal of dross, attempts have been made to use a pump to pump molten zinc from spaces where dross accumulated to outside the pot. However, implementation or commercialization of pumping proposals face formidable problems primarily associated with the difficulties in handling molten metal. For example, Japanese patent application 2-141563 discloses a pump for removing bottom dross from a dip plating cell. Dross is pumped from the bottom of the plating cell and passed through a filter to separate the dross from molten zinc. Since the pump and filter are positioned external of the plating cell, a long stationary suction pipe extends from the plating cell to the pump. Japanese patent application 6-41705 discloses a pump for removing bottom dross from a dip galvanizing vessel. The dross is pumped from the bottom of the vessel and passed through a settling box where the dross is separated from molten zinc. The pump is positioned external of the galvanizing vessel and a long stationary suction pipe extending into the galvanizing vessel is required. The settling box is positioned within the gralvanizing vessel. Positioning of the pump eternal of the coating pot is impractical because priming of the pump with liquid zinc is necessary but very difficult by practical means. This also requires a long suction pipe extending into the coating pot. A long pipe tends to become plugged as the result of chilling, if the bottom dross or molten zinc is being withdrawn too slowly through the pipe. Even if the suction pressure of the pump is adequate, bottom dross would only be locally removed in the vicinity of the inlet of the pipe since the pipe is stationary within the bath and bottom dross tends to remain agglomerated in various locations on the bottom until dispersed by high bath current.

Japanese patent application 63-69956 discloses a pump for removing suspended dross from a dip plating cell. The pump is positioned at about mid-depth within the plating cell and pumps coarse dross through a ceramic filter for separating the dross from molten metal positioned within an external pot. However, this approach only removes floating dross. The dense bottom dross that sinks to the bottom of the plating cell is not removed.

Chemical methods of removal of dross involve increasing aluminum concentration in the molten zinc to convert bottom dross to top dross has undesirable quality consequences as well. Chemical conversion of the dross during galvanneal production can not be accomplished as the amount of aluminum necessary to create the conversion of bottom dross to top dross is excessive for good quality galvanneal. Chemical conversion during galvanized production results in poor coating quality because bottom dross particles floating to the top often adhere to the surface of the strip causing dross pimples or bumps.

Accordingly, the long-felt need for efficient, reliable, and complete removal of bottom dross from a coating pot without interrupting or adversely affecting the coating operation remains unsatisfied.

Thus, one object of the present invention is to provide an efficient and reliable method and apparatus for removing bottom dross from a coating pot to insure good coating quality of steel strip emerging from the pot by mining dross particles adhered to the surface of the strip.

Another object of the present invention as to provide a method and apparatus for removing bottom dross without interrupting the coating operation A further object of the present invention is to remove bottom dross that accumulates in large areas at the bottom of the vessel.

Other objects of the present invention will become apparent to those skilled in the art upon studying this disclosure and the appended claims.

SUMMARY OF THE INVENTION

In accordance with one aspect for the present invention, an apparatus for removing bottom dross from molten zinc in a zinc pot includes a pump having a shaft long enough to position the motor above the molten zinc when the inlet of the pump is positioned as far down as the bottom of the zinc pot. The apparatus also includes a mechanism for moving the pump vertically and horizontally along the bottom of the zinc pot so that the pump intake can be placed next to the accumulated bottom dross, and repositioned in horizontal and/or vertical direction once the dross located in the vicinity of the pump's inlet is removed. This procedure is repeated until a desired amount or substantially all of the accumulated bottom dross is removed.

In accordance with a further aspect of the present invention, a ceramic pump for removing bottom dross includes a motor, an impeller, a shaft operatively connected to the motor and to the impeller and housing. The housing encloses the impeller and defines an inlet and an outlet of the pump. The shaft of the pump is long enough to maintain the motor above the surface of the molten metal when the pump is lowered to remove bottom dross from the bottom of the vessel containing the molten metal. A tubular member can be provided to enclose the shaft, especially when the shaft is relatively long. An annular space defined between the housing and the impeller is large enough to allow pumping of the molten metal and dross. The holes extending through the impeller are also large enough to avoid plugging of the pump by the bottom dross aggregates. The tubular member includes a plurality of openings facing in the direction opposite from the inlet; the openings are preferably located about 2 inches above the bottom of the tubular member.

In accordance with another aspect of the present invention, the apparatus for removing and recovering bottom dross includes a runner having a V-shaped bottom section for transporting the pumped out zinc that contains bottom dross.

In accordance with a still further aspect of the present invention, the apparatus includes a removable sedimentation tank positioned within a premelt tank.

Other features, aspects and advantages of the present invention will become apparent to those skilled in the art upon consideration of this specification, including the detailed description, the drawings, and the claims.

DETAILED DESCRIPTION OF THE INVENTION

Figure 1:
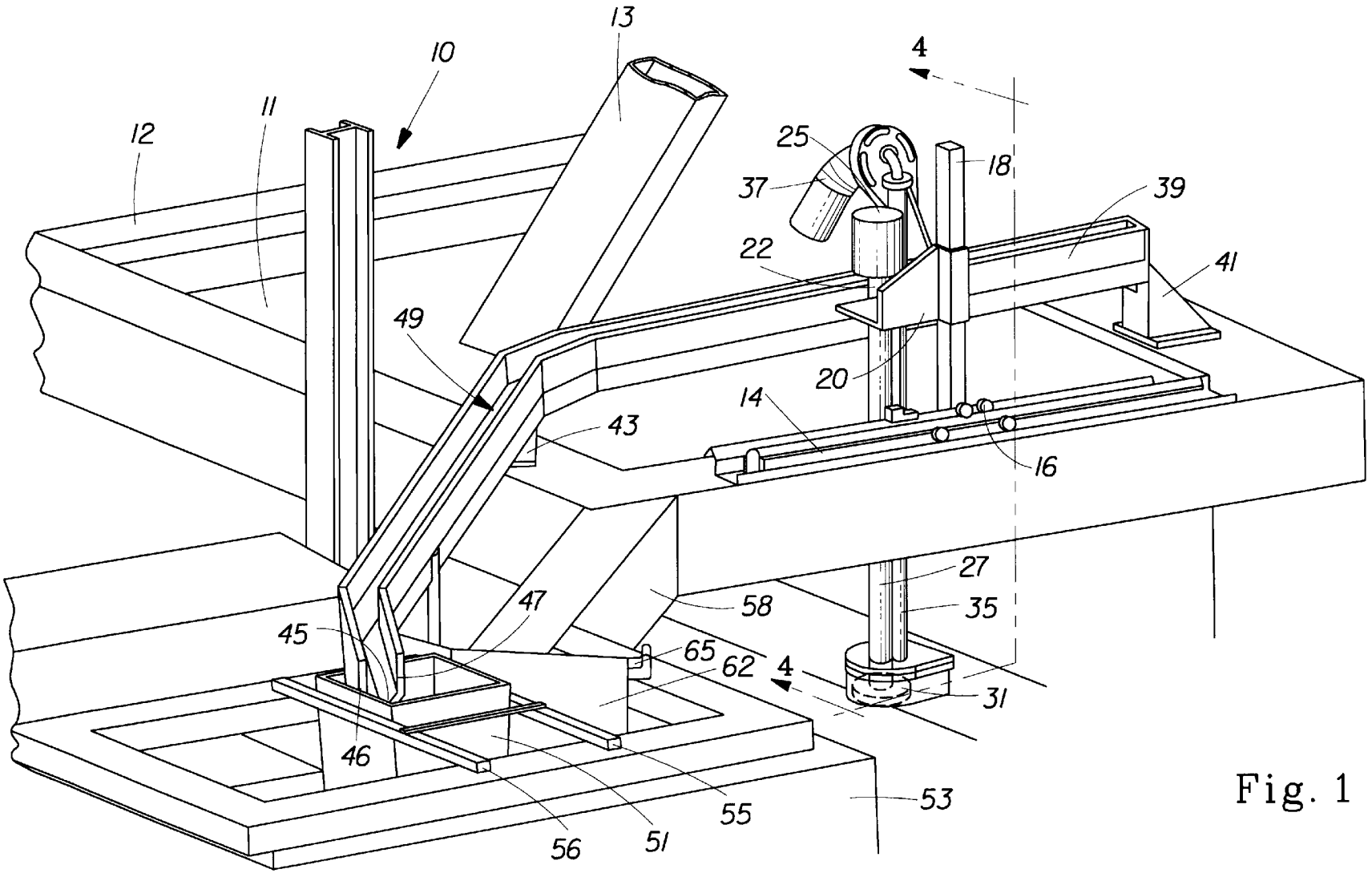
FIG. 1 is a perspective view of apparatus for removing and recovering bottom dross embodying the present invention.
Figure 2:
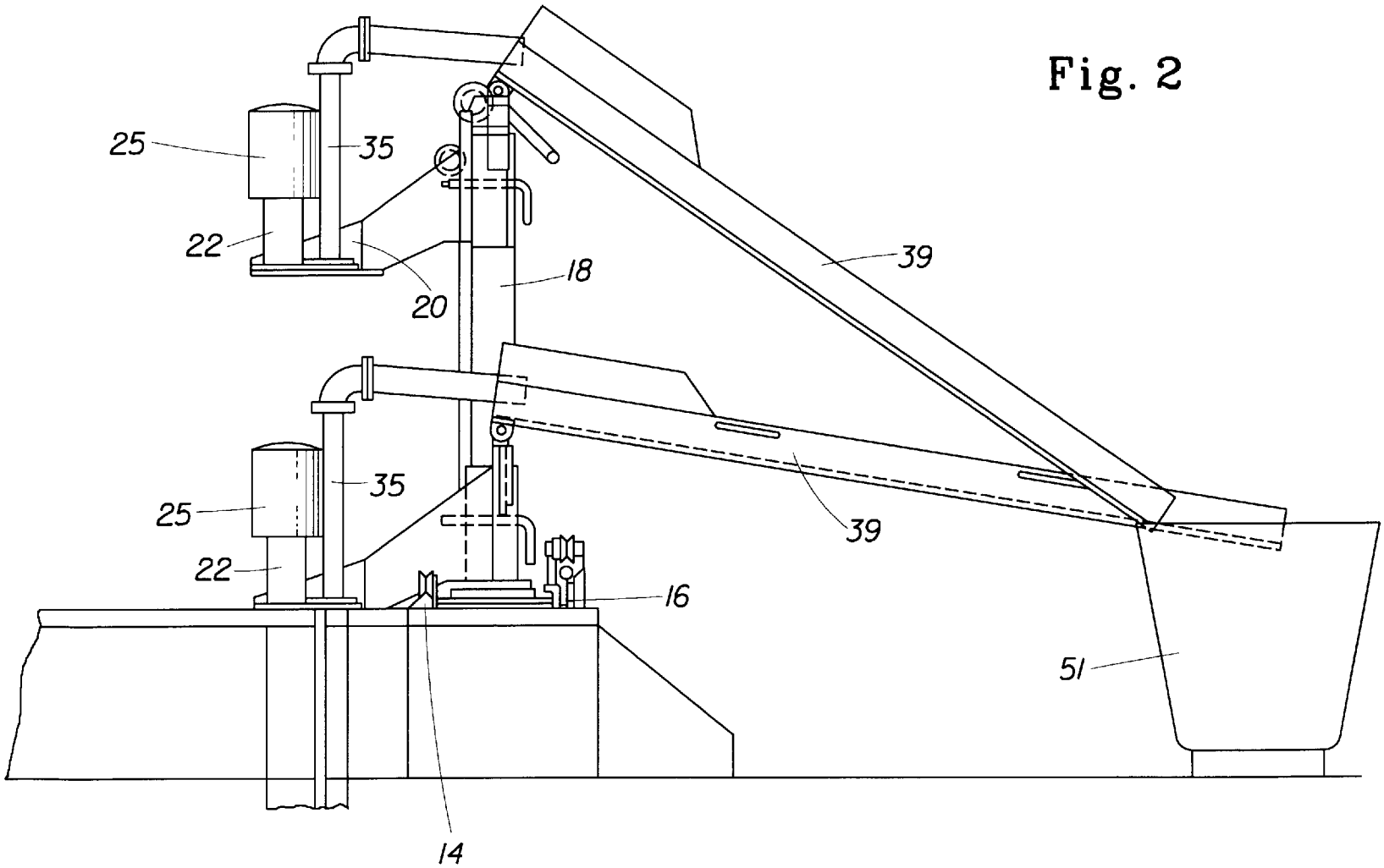
FIG. 2 is a side-elevation view of the apparatus of FIG. 1.
Figure 3:
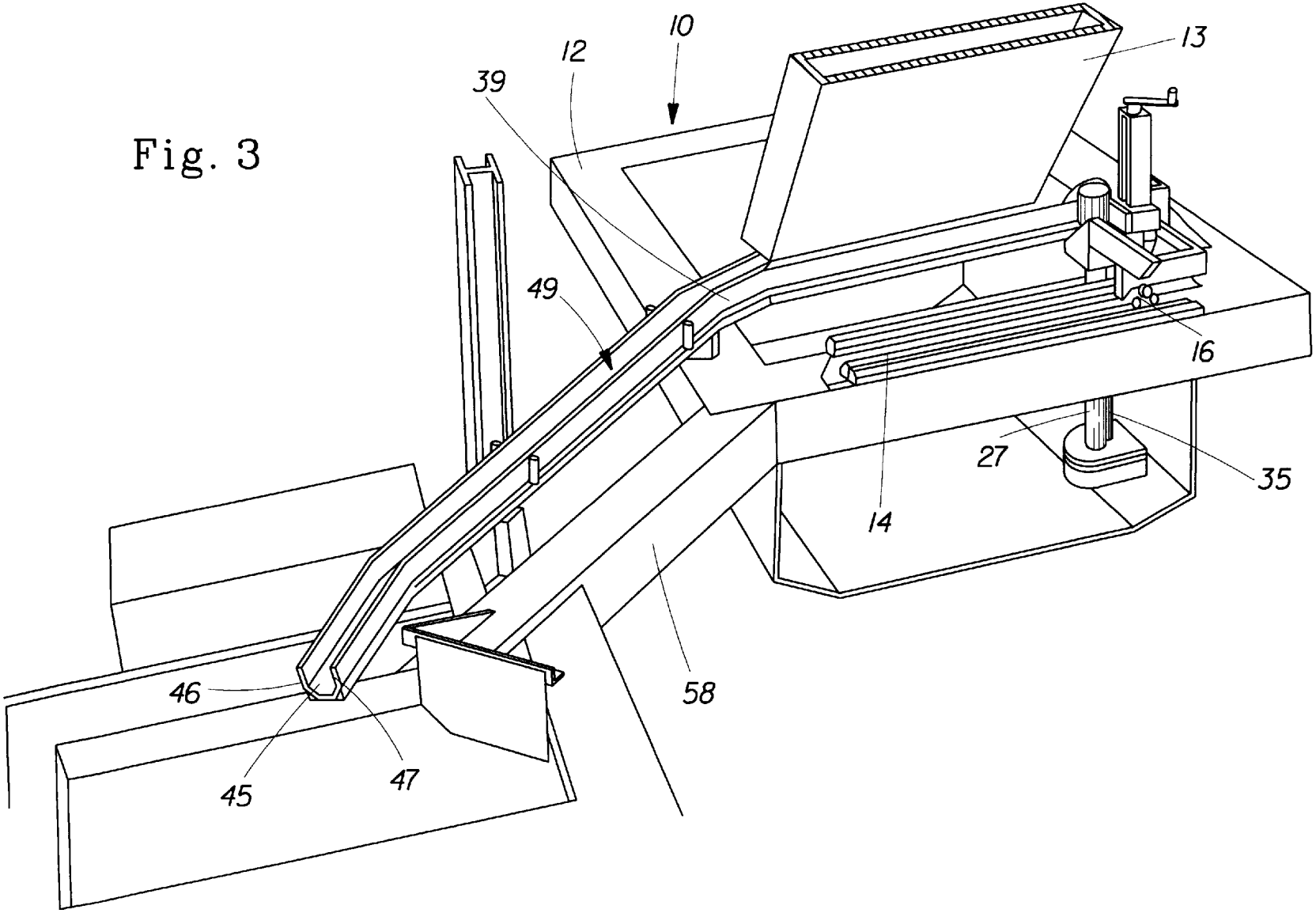
FIG. 3 is perspective of another embodiment of the present invention.
Figure 4:
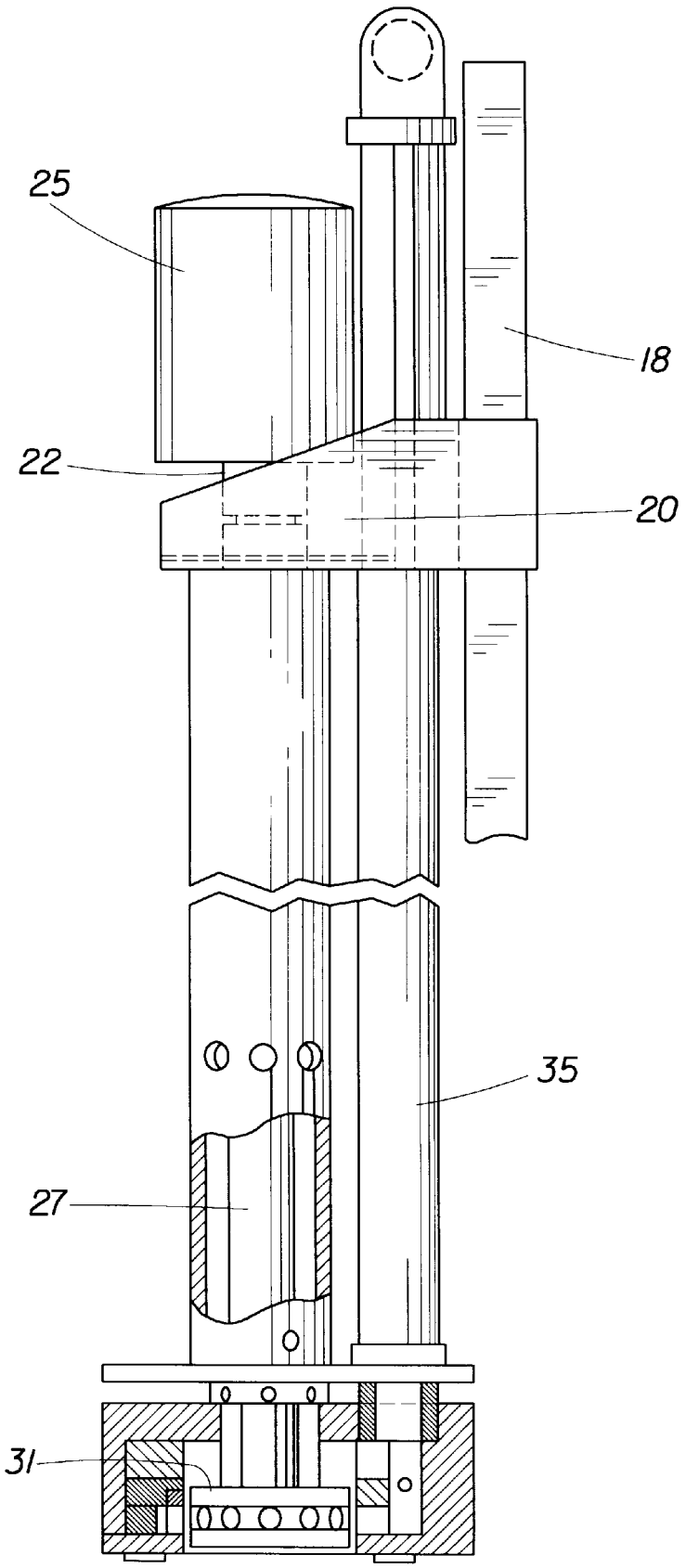
FIG. 4 is a view of a pump constructed in accordance with the present invention.

It has been discovered that bottom dross which accumulates in a molten pot during galvanizing or galvannealing can be efficiently removed and/or recovered using a system of the present invention, including an improved pump and mechanisms for positioning the pump in a desired horizontal and vertical positions.

In accordance with the present invention, the inlet of the pump is positioned in a desired location with respect to the accumulated bottom dross. The zinc containing bottom dross is pumped out and the pump is then repositioned in vertical and/or horizontal direction and the procedure is repeated until bottom dross is removed from the vicinity of the inlet to the pump. This procedure allows the removal of substantially all accumulated bottom dross from the pot. Moreover, the removal process can be carried out without interrupting the coating operation.

The improved pump of the present invention includes a motor, an impeller and a shaft operatively connected to the motor and the impeller for driving the impeller. The impeller is enclosed by a housing which defines a pump inlet. The inlet of the pump communicates with the generally annular space around the impeller defined between the inner wall of the housing and the outer surface of the impeller. The distance in the annular space between the wall and the impeller should be large enough to avoid plugging but small enough to allow pumping of the molten zinc. Preferably, this distance should be from about 5 to about 15 times the size of the average diameter of the dross. Generally, bottom dross formed in zinc plating processes is in the range from about 0.002 to about 0.050 inches in diameter. The impeller has a lateral wall with a plurality of holes in the lateral wall. The holes in the lateral wall have a cross-sectional area that is in the range from about 1 to about 6 square inches.

The shaft of the pump of the present invention should be long enough to maintain the pump's motor above the surface of the molten metal when the inlet of the pump is positioned near the bottom of the pot. Generally, the length of shafts used for removing bottom dross from a zinc pot is in the range from about 50 to about 80 inches. The shaft is preferably enclosed by a tubular member having an inside diameter slightly larger than the diameter of the shaft. The tubular member provides stability to the shaft during operation. The tubular member preferably has a plurality of laterally spaced openings about 2 inches from its bottom end. Each opening in the tubular member has a cross-sectional area in the range from about 0.05 square inches to about 0.20 square inches.

The shaft, the tubular member, the impeller, the housing, and the outlet conduit and other parts of the pump which come in contact with molten zinc are made of a ceramic material, preferably graphite.

This invention is particularly applicable to processes that include a step of hot dip or immersion coating of continuous lengths of metal strip or foil with molten metal. The preferred application of this invention is for removal of bottom dross from the bottom of a pot containing a molten bath of zinc coating metal, including pure zinc and alloys of zinc. Zinc alloys may include small additions of aluminum, e.g., 0.10–0.30 wt. %, magnesium, antimony and the like for enhancing adhesion or appearance of the adhesion of the zinc to the substrate or a steel strip during fabrication, as well as, additions of aluminum up 50 wt. % or more. Continuous lengths of metal strip or foil for use with the invention may include a variety of steels such as low carbon steel, deep drawing steel, high strength steel, chromium alloyed steel, stainless steel and the like.

Advantages of the invention include producing galvanized or galvannealed steel strip having a dross free surface, a pump inlet positioned adjacent to the bottom dross to provide for excellent sucking action, removal of bottom dross from a large surface area because of the ability of the pump to be moved transversely or longitudinally or vertically, minimal loss of molten zinc from the coating pot, and smooth, reliable operation for extended periods of time. Also, no loss of production time due to the drossing technique.

DESCRIPTION OF THE PREFERRED EMBODIMENT

The preferred embodiments of the present invention are depicted in the drawings in connection with a removal of bottom dross from a zinc pot. The preferred embodiments shown in the drawings are provided to further illustrate the present invention and are not intended to limit the scope of the present invention, as defined by the claims.

Referring now to the drawings, FIGS. 1–5 depict an apparatus constructed in accordance with the present invention, for removing and recovering bottom dross from a zinc pot of a hot dip zinc coating line. A rectangular zinc pot is generally designated by a numeral 10. The pot 10 contains molten zinc 11. A snout of a galvanizing furnace 13 extends into the zinc 11. The pot 10 includes a generally horizontal ledge 12. A track 14, mounted on the ledge 12, accommodates a traversing carriage 16. The carriage 16 supports a vertical slide post 18. A supporting brace 20 is slideably mounted on the slide post 18. A pump 22 is secured to the supporting brace 22. The pump 22 includes a motor 25, a housing 27, which encloses a shaft (not shown in FIG. 1), an impeller housing 31. An exit tube 35 communicates with an outlet (not shown in FIG. 1) of the pump 22 and extends into a directional elbow 37. The directional elbow 37 is positioned above a zinc runner 39 which is mounted to the ledge 12 by braces 41 and 43. As shown in FIG. 1, the runner 39 has a V-shaped bottom portion 45 and generally vertical walls 46 and 47. The portion 45 and the vertical walls 46 and 47 define a flow channel 49 in the runner 39. The runner 39 extends on one side to basket 51 located on a pre-melt pot 53. The basket 51 is supported on the pre-melt pot 53 on bars 55 and 56. A zinc return conduit 58 provides communication between the pot 10 and the pre-melt pot 53. A small generally vertical baffle 62 is mounted in the pre-melt pot 53 on a bar 65.

Figure 5:
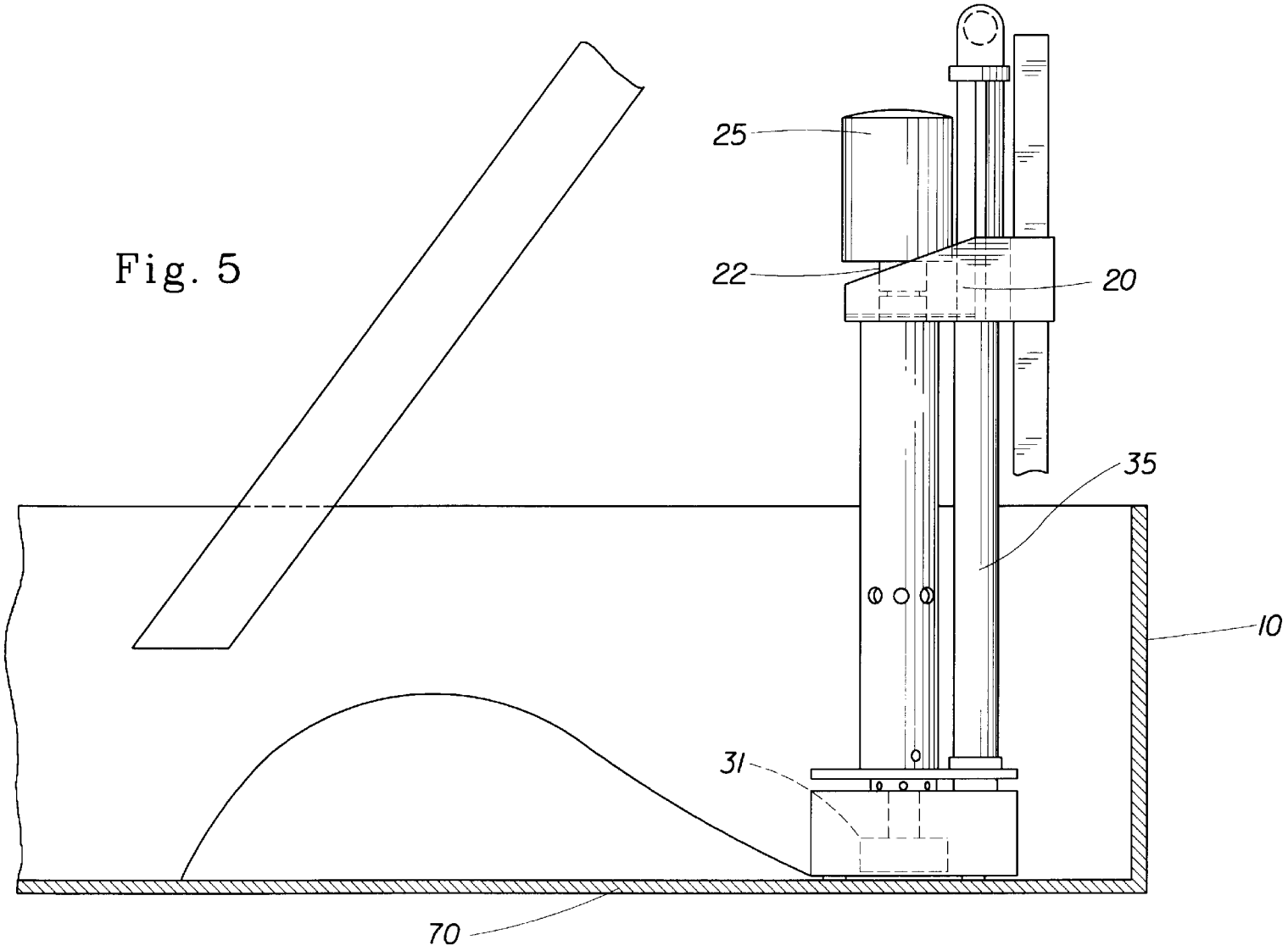
FIG. 5 is a cross-sectional view of a zinc pot containing accumulated bottom dross and a pumping apparatus constructed in accordance with the present invention.

In operation, the pump 22 is positioned so that the pump inlet is next to the accumulated bottom dross 70, as shown in FIG. 5. To position the inlet of the pump 22 in a desired horizontal location, the traversing carriage 16 is moved along the track 14. To position the inlet of the pump 22 in a desired horizontal location, the side 20 is moved along the vertical slide post 18. Once the pump 22 is positioned in the desired vertical and horizontal location, the pump is turned on the and the pump draws molten zinc with the accumulated bottom dross into the inlet and pumps the zinc through outlet and the exit tube into the direction elbow 37. The direction elbow 37 is positioned above the zinc runner 39 so as to discharge the molten zinc into the flow channel 49. The flow channel 49 is inclined so as to cause the discharged zinc to flow along the channel 49 and into the basket 51.

Once bottom dross is pumped out of the location near the inlet to the pump 22, the pump is moved to an adjacent location and the pumping is repeated until bottom dross has been pumped out from the zinc pot 10. Once the basket 51 is filled with molten zinc, it is removed and either subject to a process of separating bottom dross from the molten zinc or allowed to solidify for further processing.

The following examples are provided to further illustrate the present invention. These examples are not intended to limit the scope of the present invention as defined by the claims.

EXAMPLE 1

An initial plant trial will now be described. Galvannealed strip was produced during several campaigns lasting a total of about 600 hours. The zinc pot used had a capacity of 150 tons of molten zinc with an attached premelt pot of 15 tons. Near the conclusion of a scheduled galvanneal campaign, and just prior to resumption of a regular galvanizing schedule, a graphite metal pump was submerged into the bath with the pump inlet maximum position of 12 inches from the bottom of the coating pot. A suitable pump for this purpose was a 2,800 pound per minute pump operated by a compressed air driven-5 horsepower motor at 45 psi. Pump model A801, available from High Temperature Systems of Chagrin Falls, Ohio, USA was used. Pump had been extended 40 inches longer than standard per AK Steel specifications. Total pump immersion length possible was 60 inches The pump was operated a total time of 60 minutes. During the time of operating, the pump was traversed across the zinc pot to remove the accumulated bottom dross. This was done at progressively lower heights so as not to clog the pump with too much dross. The pump moved the dross along with zinc into two zinc bailers (i.e. about 5,000 lbs each). Accumulated bottom dross was lowered from a maximum of 35 inches to 18 inches in vicinity of the pump travel.

EXAMPLE 2

Another plant trial was conducted during the time of a line stop. No product was being produced at the time. The zinc pot and premelt pot are the same as example 1. A new pump was used in the traversing apparatus and submerged 26 days prior to operation. The new pump was a model A802 (later renamed to B1501) with a total immersion length of 66 inches. This placed the maximum depth of the pump inlet to 6 inches from the pot floor. The pump was capable of 4,500 lbs per minute capacity. The clearance of the pump was manufacturer's original at 9×the dross diameter between impeller and bearing surface. Bottom dross had accumulated over several campaigns of galvanneal production. Maximum depth of dross was 41 inches in the vicinity of the pump. Pumping was started with the inlet about 30 inches from the floor bottom. Successive traversing passes were made with the pump in operation pumping both dross and zinc. After each traversing pass, the pump was lowered about 6 inches until the final pass when the pump inlet was 6 inches from the pot floor. The zinc metal and dross was directed from the pump exit by a zinc runner system to a premelt pot equipped with a 20 mesh wire basket for screening of the dross laden metal. When pumping was completed, the maximum dross level in the pump path had been reduced from 41 inches to 5 inches. Dross was collected in the screen basket, floating in the premelt pot, and accumulated on the bottom of the premelt pot. Total dross removed from the main operating pot was 30–50%.

EXAMPLE 3

Galvanizing line was operating on heavy gage galvanneal product at 120 feet per minute. The same pump from example 2 was used. The pump was operated 40–50 psi air pressure, lowered and traversed across the operating pot 4 times until no accumulation of bottom dross was detected under the pump. Total pumping time was about 60 minutes.

Dross was removed from the premelt by skimming and accumulating in the bottom to be reacted later with Al. About 3,000 lbs was removed by skimming. No detrimental effects on the product being produced were noted.

EXAMPLE 4

A larger capacity B2000 pump of same length and weep hole arrangement as example 2 was used for the pumping operation. Additionally, a larger clearance of 13×dross diameter for the impeller diameter was used to reduce binding due to dross particles. Dross laden zinc was pumped by traversing across the operating pot for a total time of 15 minutes. Dross was removed from the operating pot from a level of 32 inches to 22 inches with an estimated volume of 10 cubic feet. The dross laden zinc was pumped to an ingot mold.

It will be understood various modification can be made to the invention without departing from the spirit and scope of it. Therefore, the limits of the invention should be determined from the appended claims.

What is claimed is:

1. An apparatus for removing bottom dross from a molten metal in a dip coating container, the molten metal having a top surface, said apparatus comprising:

a pump including a shaft having a bottom portion and a top portion, an impeller operatively connected to the bottom portion of the shaft, a housing surrounding the top and the sides of the impeller and defining an inlet, said housing having an inside lateral wall, an annular channel being formed between the impeller and the lateral wall of the housing, an outlet conduit having a pump end communicating with the annular channel and having an upper end extending above the surface of the molten metal, a motor operatively connected to the top portion of the shaft for rotating the shaft and the impeller connected to the bottom portion of the shaft so as to centrifugally force the molten metal to flow into the inlet, through the impeller and through the outlet conduit;

a horizontal support;

a vertical support;

a mechanism operatively connected to said pump for moving said pump along said horizontal support and along said vertical support so as to position the inlet adjacent to the accumulated bottom dross, said shaft being long enough to maintain the motor above the surface of the molten metal in said dip coating container during the removal of the bottom dross.

2. The apparatus of claim 1 wherein the molten metal is zinc.

3. The apparatus of claim 1 wherein the shaft, the impeller, the housing and the outlet conduit are made of graphite.

4. The apparatus of claim 1 further comprising a tubular lateral wall with opening holes spaced laterally around said wall said wall enclosing said shaft.

5. The apparatus of claim 4 wherein the impeller includes a plurality of holes through its lateral wall and wherein the cross-sectional area of the holes is in the range from about 1 square inches to about 6 square inches.

6. The apparatus of claim 4 wherein the distance between the inner wail of the housing and lateral wail of the impeller is in the range of from about 10 to about 15 times the average diameter of the bottom dross particles in said container.

7. A pump for removing bottom dross from a molten metal in a dip coating container, said molten metal having a top surface, said pump comprising:

a shaft having a bottom portion and a top portion;

an impeller, having a lateral cylindrical wall and a top wall forming an impeller chamber, said impeller being operatively connected to the bottom portion of the shaft, the cylindrical wall having a plurality of holes therethrough, each of said holes having cross sectional area in the range from about 1 square inch to about 6 square inches;

a housing surrounding the top and the sides of the impeller and defining an inlet, said housing having an inside lateral wall, an annular channel being formed between the impeller and the lateral wall of the housing, the distance between the inside wall and the cylindrical wall in the annular channel being in the range from about 5 to about 15 times the average diameter of the bottom dross to be removed;

an outlet conduit having a pump and communicating with the annular channel and having an upper end extending above the top surface of the molten metal;

a motor operatively connected to the top portion of the shaft for rotating the shaft and the impeller connected to the bottom portion of the shaft so as to force the molten metal to flow through the inlet, into the impeller chamber through the holes of the cylindrical wall, into the channel and through the outlet conduit past the upper end.

8. The apparatus of claim 7 wherein the molten metal is zinc.

9. The apparatus of claim 7 wherein the shaft, the impeller, the housing and the outlet conduit are made of graphite.

10. The apparatus of claim 7 wherein the impeller has a tubular lateral wall with a plurality of holes spaced laterally around said wall.

11. The apparatus of claim 10 wherein the cross-sectional area of the holes is in the range from about 1 square inch to about 6 square inches.

12. The apparatus of claim 11 wherein the distance between the inner wall of the housing and lateral wall of the impeller is in the range of from about 10 to about 15 times the average diameter of the bottom dross to be removed.

13. The apparatus of claim 7 wherein the shaft, the impeller and the housing are made of a ceramic material.

14. A system for removing and recovering bottom dross from a molten metal in a dip coating container, the molten metal having a top surface, said system comprising:

a pump including a shaft having a bottom portion and a top portion, an impeller operatively connected to the bottom portion of the shaft a housing surrounding the top and the sides of the impeller and defining an inlet, said housing having an inside lateral wall, an annular channel being formed between the impeller and the lateral wall of the housing, an outlet conduit having a pump end communicating-with the annular channel and having an upper end extending above the surface of the molten metal, a motor operatively connected to the top portion of the shaft for rotating the shaft and the impeller connected to the bottom portion of the shaft so as to force the molten metal to flow into the inlet, through the impeller and through the outlet conduit;

a mechanism for holding and moving the pump in vertical and horizontal directions;

an open conduit communicating with the upper end of the outlet conduit and with the container.

15. The apparatus of claim 14 wherein the molten metal is zinc.

16. The apparatus of claim 14 wherein the shaft, the impeller and the housing are made of graphite.

17. The apparatus of claim 14 wherein the impeller has a tubular lateral wall with a plurality of holes spaced laterally around said wall.

18. The apparatus of claim 16 wherein holes have a cross-sectional area in the range from about 1 square inch to about 6 square inches.

19. The apparatus of claim 18 wherein the distance between the inner wall of the housing and lateral wall of the impeller is in the range of from about 5 to about 15 times the average diameter of the bottom dross being removed.

20. The system of claim 14 wherein the open conduit has a V-shaped bottom cross section.

21. The system of claim 14 wherein the molten metal is zinc.

22. The apparatus of claim 14 wherein the shaft, the impeller and the housing are made of a ceramic material.

23. The apparatus of claim 14 wherein the mechanism includes a carriage providing the transverse movement of the pump from one side of the pot to an opposing side.

24. The apparatus of claim 23 wherein the mechanism includes the carriage is adapted for travel along an upper surface of the pot.

25. The apparatus of claim 23 wherein the mechanism includes an elongated track on the upper surface of the pot for supporting the carriage.

* * * * *